US010468764B2

(12) United States Patent
Kugler et al.

(10) Patent No.: US 10,468,764 B2
(45) Date of Patent: Nov. 5, 2019

(54) ANTENNA SYSTEM AND METHOD FOR MANUFACTURING AN ANTENNA SYSTEM

(71) Applicant: Robert Bosch GmbH, Stuttgart (DE)

(72) Inventors: Andreas Kugler, Alfdorf (DE); Johannes Meyer, Boeblingen (DE); Juergen Seiz, Welzheim (DE); Klaus Baur, Mietingen (DE); Marcel Mayer, Lonsee (DE); Osama Khan, Stuttgart (DE); Alexander Fischer, Untergruppenbach (DE)

(73) Assignee: Robert Bosch GmbH, Stuttgart (DE)

( * ) Notice: Subject to any disclaimer, the term of this patent is extended or adjusted under 35 U.S.C. 154(b) by 5 days.

(21) Appl. No.: 15/551,420

(22) PCT Filed: Jan. 15, 2016

(86) PCT No.: PCT/EP2016/050771
§ 371 (c)(1),
(2) Date: Aug. 16, 2017

(87) PCT Pub. No.: WO2016/131570
PCT Pub. Date: Aug. 25, 2016

(65) Prior Publication Data

US 2018/0062255 A1 Mar. 1, 2018

(30) Foreign Application Priority Data

Feb. 17, 2015 (DE) ..... 10 2015 202 801

(51) Int. Cl.
*H01Q 1/38* (2006.01)
*H01Q 1/40* (2006.01)
(Continued)

(52) U.S. Cl.
CPC ..... *H01Q 1/405* (2013.01); *H01Q 1/38* (2013.01); *H01Q 9/0414* (2013.01);
(Continued)

(58) Field of Classification Search
CPC ..... H01Q 1/38; H01Q 1/40; H01Q 1/405; H01Q 1/3233; H01Q 21/0075;
(Continued)

(56) References Cited

U.S. PATENT DOCUMENTS 4,866,451 A * 9/1989 Chen ..... H01Q 9/0428 343/700 MS
5,438,697 A * 8/1995 Fowler ..... H01Q 9/0407 333/204
(Continued)

FOREIGN PATENT DOCUMENTS

DE 102004053419 A1 5/2006
DE 102012201367 A1 8/2013
(Continued)

OTHER PUBLICATIONS

3-Dimensional Circuitry Laser Direct Structuring Technology (LPKF-KDS) for Moulded Interconnect Devices, (2014), pp. 1-12, XP055257222.
(Continued)

*Primary Examiner* — Tho G Phan
(74) *Attorney, Agent, or Firm* — Norton Rose Fulbright US LLP; Gerard Messina

(57) ABSTRACT

An antenna system and a method for manufacturing same. The antenna system includes a substrate having a first outer side on which a first antenna structure is mounted; a radome spaced apart from the substrate on the first outer side of the substrate; a carrier device situated between the substrate and the radome which includes an insulating material; and at least one second antenna structure mounted on the carrier device which is spaced apart from the substrate and the radome.

9 Claims, 6 Drawing Sheets

(51) Int. Cl.

| | |
|---|---|
| ***H01Q 9/04*** | (2006.01) |
| ***H01Q 21/00*** | (2006.01) |
| *H01Q 1/32* | (2006.01) |
| *H01Q 21/06* | (2006.01) |
| *H01Q 23/00* | (2006.01) |

(52) U.S. Cl.
CPC ..... *H01Q 21/0075* (2013.01); *H01Q 21/0087* (2013.01); *H01Q 1/3233* (2013.01); *H01Q 21/065* (2013.01); *H01Q 23/00* (2013.01)

(58) Field of Classification Search
CPC .. H01Q 21/0087; H01Q 21/065; H01Q 23/00; H01Q 9/0414
See application file for complete search history.

(56) References Cited

U.S. PATENT DOCUMENTS 5,572,222 A * 11/1996 Mailandt ..... H01Q 21/0075 343/700 MS
5,625,365 A * 4/1997 Tom ..... G01S 19/36 343/700 MS
6,492,950 B2 * 12/2002 Nakano ..... H01Q 1/40 343/700 MS
7,636,063 B2 * 12/2009 Channabasappa ... H01Q 9/0442 343/700 MS
9,030,364 B2 * 5/2015 Zhuang ..... H01Q 9/0428 343/700 MS
9,660,314 B1 * 5/2017 Mehta ..... H01Q 9/0442
2013/0285877 A1 10/2013 Desclos et al.
2016/0049723 A1 2/2016 Baks et al.

FOREIGN PATENT DOCUMENTS

| | | | |
|---|---|---|---|
| JP | S63199503 | A | 8/1988 |
| JP | H02141007 | A | 5/1990 |
| JP | H11274845 | A | 10/1999 |
| JP | 2009188895 | A | 8/2009 |
| JP | 2009218971 | A | 9/2009 |
| JP | 2011517915 | A | 6/2011 |
| JP | 2012085044 | A | 4/2012 |
| WO | 2004066443 | A1 | 8/2004 |

OTHER PUBLICATIONS

Isola FR408 Specifications High Performance Laminate and Prepreg, (2012), pp. 1-2. XP055257950.
International Search Report dated Mar. 22, 2016, of the corresponding International Application PCT/EP2016/050771 filed Jan. 15, 2016.
U.K Revankar et al: "Experimental investigation of three-layer electromagnetically coupled circular microstrip antennas", Electronics Letters; Bd. 27, Nr. 13, Jan. 1, 1991, p. 1187, XP055257116.
Shi Cheng et al: "79 GHz Slot Antennas Based on Substrate Integrated Waveguides (SIW) in a flexible Printed Circuit Board", IEEE Nternational on Antennas and Propagation, IEEE Service Center; Piscataway, NJ, US, Bd. 57, Nr. 1, Jan. 1, 2009, pp. 64-71, XP011253031.

* cited by examiner

ANTENNA SYSTEM AND METHOD FOR MANUFACTURING AN ANTENNA SYSTEM

FIELD

The present invention relates to an antenna system and a method for manufacturing an antenna system.

BACKGROUND INFORMATION

Radar sensors, which are often used for detecting the surroundings in vehicles with modern driver assistance systems, are operated in the frequency band of 76-77 GHz, for example. Enhanced radar sensors may have an extended frequency range of 76 GHz to 81 GHz, for example. Advantages of this increased available bandwidth are, for example, an increased spatial separation capability or the option for operating the radar sensor in different ranges of the frequency band in order to avoid disturbances due to interference by other radar sensors in the immediate vicinity.

In conventional radar sensors, irradiation of electromagnetic waves as radar waves is generally achieved using so-called patch antennas in the microstrip line technology. In the simplest case, a rectangular metal-plated antenna element (also referred to as a patch element) is situated on a circuit board substrate material, suitable for high frequencies, at a defined distance from a ground surface situated below same. Substrates that are suitable for high frequencies are relatively complicated technically, and are often difficult to integrate into standardized manufacturing processes.

One-layer substrate assemblies are sometimes limited in the possible frequency bandwidth, and for the frequency band of 76 GHz to 81 GHz, for example, have only limited usability. Multilayer substrate assemblies, which include multiple substrate layers suitable for high frequencies with etched structures, are often technically complex and involve a high level of manufacturing effort.

German Patent Application No. DE 10 2012 201 367 A1 describes a microwave radar device that is designed as a module made up of multilayer multipolymer circuit boards which include a metal-plated layer that is situated between two layers made of polymer materials and used for shielding and for signal routing.

FIG. 6*a* shows a schematic illustration of an example of an antenna system from the related art, and FIG. 6*b* shows a schematic cross-sectional view of the example of the antenna system from the related art.

Basic elements of the example of the antenna system are a first patch element 3, which is situated on a substrate material 4 above a ground surface 5 and coupled to a second patch element 1, which is mounted on a second material 2.

SUMMARY

The present invention provides an antenna system as described herein, and a method for manufacturing an antenna system as described herein.

In accordance with an example embodiment of the present invention, an antenna system is provided that is designed with the following:

a substrate having a first outer side on which a first antenna structure is mounted; a radome, spaced apart from the substrate, on the first outer side of the substrate; a carrier device, situated between the substrate and the radome, which includes an electrical insulation material; and at least one second antenna structure being mounted on the carrier device and being spaced apart from the substrate and the radome.

Moreover, a method for manufacturing an antenna system is provided which includes the following steps: forming a first antenna structure on a substrate; forming a radome that is spaced apart from the substrate; forming a carrier device, situated between the substrate and the radome, which includes an electrical insulation material; and forming at least one second antenna structure, which is spaced apart from the substrate and the radome, on the carrier device.

When it is stated that a first element is formed "on" an outer side of a second element, this is understood to mean that it is formed directly on the second element at the outer side, i.e., the outer surface, of the second element, and also that it is formed directly above this outer side. When it is stated that first element is formed "at" the outer side of the second element, this is understood to mean that it is formed directly at the outer side, i.e., the outer surface. When it is stated that the first element is situated in a certain way with respect to a second element, it is not necessarily intended that the second element must already be formed when the first element is formed. Rather, an end state is described here, which those skilled in the art understand how to produce according to the description.

In accordance with the present invention, a technology that departs from multilayer substrate assemblies may be used for implementing broadband antenna elements. Such broadband antennas may be situated and used, for example, in radar sensors, in particular in automotive radar sensors.

In accordance with the present invention, metallic structures are mounted on additional carrier devices or carrier devices that are present on the housing. A multilayer overall antenna structure in the microstrip design is provided, whereby a first antenna structure of the antenna system is produced on classical high-frequency substrates, for example, while at least one second antenna structure is mounted on a carrier device that is spaced apart from the classical high-frequency substrate, for example. The individual antenna structures of the overall antenna structure may be designed in particular as flat microstrips. The term "flat" is understood in particular to mean that the microstrips of each individual antenna structure, considered on their own, are situated essentially in one plane. The planes in which the antenna structures are mounted in each case are preferably situated in parallel to one another. The term "essentially" is understood in particular to mean that the property qualified in this way is present within the scope of unavoidable and/or negligible inaccuracies, depending on the specific use.

According to the present invention, antenna systems having an increased bandwidth may be provided, in particular when the antenna system has a fixed surface area, whereby processes that are complicated and technically difficult to manage may advantageously be avoided.

A radome is understood in particular to mean a housing termination for protection from external influences, for example mechanical stresses, impacts, moisture, etc., which are frequently present in customary radar sensors. A radome may be designed, for example, as a radar-transparent plastic cover.

Advantageous specific embodiments and refinements result from the subclaims and from the description, with reference to the figures.

According to one preferred refinement, the carrier device is made of the electrical insulation material. The carrier device in particular includes neither a material that is an electrical conductor nor a material that is an electrical semiconductor. The carrier device may thus have a particularly simple design, thereby reducing the manufacturing complexity and the susceptibility to errors.

According to another preferred refinement, the electrical insulation material is a thermosetting plastic. An electrical insulation material is particularly preferably made of a thermosetting plastic based on epoxy resin, optionally modified with specific fillers. Such materials have particularly advantageous properties with regard to permeability to electromagnetic waves, in particular radar beams.

According to another preferred refinement, the carrier device has a one-piece design. Manufacturing the carrier device is thus particularly easy to accomplish, and tolerances of the carrier device may be checked beforehand.

According to another preferred refinement, the carrier device is situated in part directly on the substrate, and in part spaced apart from the substrate. In particular, the carrier device together with the substrate may form a cavity having two wall surfaces facing one another, on whose first wall surface the first antenna structure is mounted, and on whose second wall surface the at least one second antenna structure is mounted. In addition, the carrier device may thus be directly adjusted with respect to the substrate, which is advantageous for meeting required tolerances.

According to another preferred refinement, the carrier device is situated in part directly on the radome, and in part spaced apart from the radome. The carrier device together with the radome may form a cavity, the at least one second antenna structure being situated on a surface, in particular an outer side, of the carrier device, facing the radome but spaced apart from the radome by the cavity.

According to another preferred refinement, one of the at least one second antenna structures is situated at a first outer side of the carrier device facing the substrate.

According to another preferred refinement, one of the at least one second antenna structures is situated at a second outer side of the carrier device facing away from the substrate.

According to another preferred refinement, a third antenna structure is situated at an outer side of the radome facing the substrate.

BRIEF DESCRIPTION OF THE DRAWINGS

The present invention is explained in greater detail below with reference to the exemplary embodiments illustrated in the schematic figures.

DETAILED DESCRIPTION OF EXAMPLE EMBODIMENTS

Figure 1:
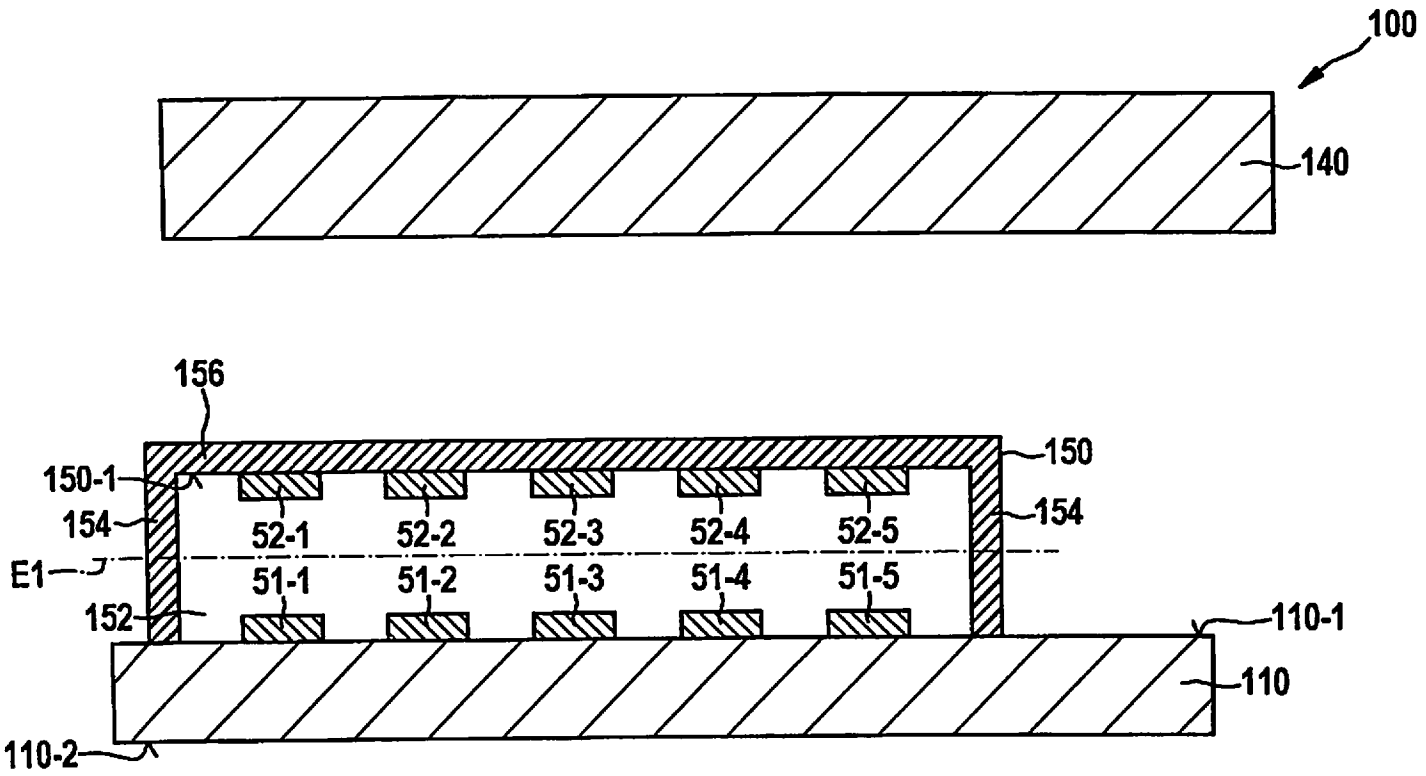
FIG. 1 shows a schematic cross-sectional view of an antenna system 100 according to one specific embodiment of the present invention.

Unless stated otherwise, identical or functionally equivalent elements and devices are provided with the same reference numerals in all figures. The numbering of method steps is for clarity, and unless stated otherwise, in particular is not intended to imply a specific chronological sequence. In particular, multiple method steps may be carried out at the same time.

FIG. 1 shows a schematic cross-sectional view of an antenna system 100 according to one specific embodiment of the present invention.

As shown in FIG. 1, antenna system 100 includes a substrate 110 having a first outer side 110-1 on which a first antenna structure 51-1, 51-2, 51-3, 51-4, 51-5 is mounted. The first antenna structure includes individual first patch elements 51-1, 51-2, 51-3, 51-4, and 51-5, collectively denoted below as reference numeral 51-*i*, in microstrip technology, which in particular are flatly formed on first outer side 110-1. First antenna structure 51-*i* may, for example, be fed with a high-frequency signal via strip conductors, and may therefore also be referred to as a primary antenna structure or as an active antenna structure with primary or active patch elements.

A carrier structure 150 which with first outer surface 110-1 encloses a cavity 152 is formed on, in particular at, first outer side 110-1. According to FIG. 1, carrier device 150 includes wall sections 154 that extend essentially perpendicularly with respect to first outer side 110-1, and also includes a cover section 156 that extends essentially in parallel to first outer side 110-1. Carrier device 150 may be made of a plastic, for example, in particular a polycarbonate (PC), a polyamide (PA), and/or a polyphthalamide (PPA).

Carrier device 150, in particular cover section 156, includes a first outer side 150-1 of carrier device 150 which faces first outer side 110-1 of substrate 110. Second patch elements 52-1, 52-2, 52-3, 52-4, 52-5, collectively denoted below as reference numeral 52-*i*, are mounted as a second antenna structure at first outer side 150-1 of the carrier device in such a way that they are passively excitable by electromagnetic waves emitted by first antenna structure 51-*i* and/or electromagnetically coupleable to first antenna structure 51-*i*. In other words, second antenna structure 52-*i* is not feedable with a high-frequency signal via strip conductors, and may therefore also be referred to as a secondary antenna structure, as a passive antenna structure, or as a coupling antenna structure with secondary patch elements, passive patch elements, or coupling elements.

In particular, second antenna structure 52-*i* may be situated with respect to first antenna structure 51-*i* in such a way that first antenna structure 51-*i* and second antenna structure 52-*i* are mirror images with respect to a virtual plane of symmetry E1 situated in parallel to first outer side 110-1 of substrate 110 between first antenna structure 51-*i* and second antenna structure 52-*i*. Virtual plane of symmetry E1 intersects wall sections 154 of carrier device 150, but not cover section 156 of carrier device 150. In particular, each first patch element 51-*i* of first antenna structure 51-*i* may have a design that is identical to its corresponding mirror-image second patch element 52-*i* in second antenna structure 52-*i*, at least with regard to its respective surface in parallel to first outer side 110-1 of substrate 110.

A radome 140 is situated on first outer side 110-1 of substrate 110, in particular spaced apart from carrier device 150 as well as from substrate 110, in such a way that carrier device 150 is situated between substrate 110 and radome 140.

Carrier device 150 includes an electrical insulation material, preferably a plastic, or is made of same.

Figure 2:
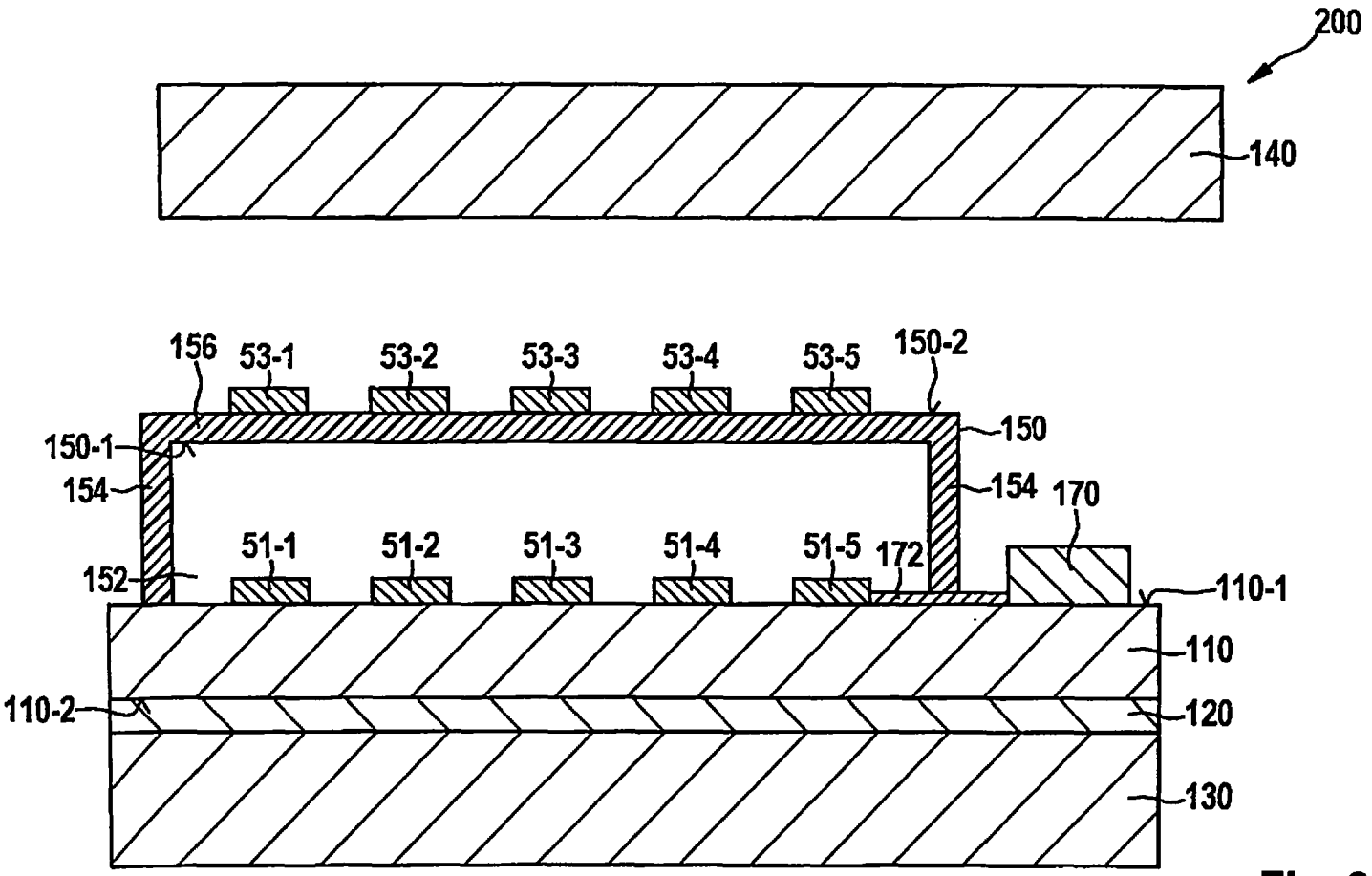
FIG. 2 shows a schematic cross-sectional view of an antenna system 200 according to one specific embodiment of the present invention.

FIG. 2 shows a schematic cross-sectional view of an antenna system 200 according to another specific embodiment of the present invention.

Antenna system 200 is a variant of antenna system 100 according to FIG. 1, and differs from same in particular in the arrangement of the second antenna structure, i.e., the secondary antenna structure or the passive antenna structure. According to FIG. 2, antenna system 200 includes a further second antenna structure with third patch elements 53-1, 53-2, 53-3, 53-4, 53-5, collectively denoted below as reference numeral **53-*i* for short, while antenna system 200 does not include second patch elements 52-*i* according to FIG. 1. Third patch elements 53-*i* are formed on a second outer side 150-2 of carrier device 150 facing away from first outer side 150-1 of carrier device 150 and facing radome 140**.

First patch elements **51-*i* of antenna system 200 are electrically connected to a transceiver 170 via galvanic strip conductors 172. Transceiver 170 may be designed, for example, as a micromechanical integrated circuit (MMIC), in particular as an application-specific integrated circuit (ASIC). According to antenna system 200, transceiver 170 is also situated on first outer side 110-1 of the substrate. Strip conductors 172 may be guided from transceiver 170 to first patch elements 51-*i*, for example underneath carrier device 150, or alternatively, through carrier device 150, in particular through one of side sections 154 of carrier device 150. With the aid of transceiver 170, output signals, in particular high-frequency signals, are transmittable to patch elements 51-*i* via strip conductors 172, and electromagnetic input signals received at patch elements 51-*i*** are receivable and evaluatable.

In addition, antenna system 200 includes a ground surface 120 and a carrier substrate 130 at a second outer side 110-2 of substrate 110 facing away from first outer side 110-1 of substrate 110, ground surface 120 being situated in a sandwich-like manner between carrier substrate 130 and second outer side 110-2 of substrate 110, in particular situated directly at second outer side 110-2 of substrate 110 and carrier substrate 130. Carrier substrate 130 in particular includes a more rigid material than the ground surface, and preferably includes an HF material, for example FR4.

Substrate 110 may in particular be formed from a classical high-frequency substrate made of a material that is suitable for high frequencies.

Figure 3:
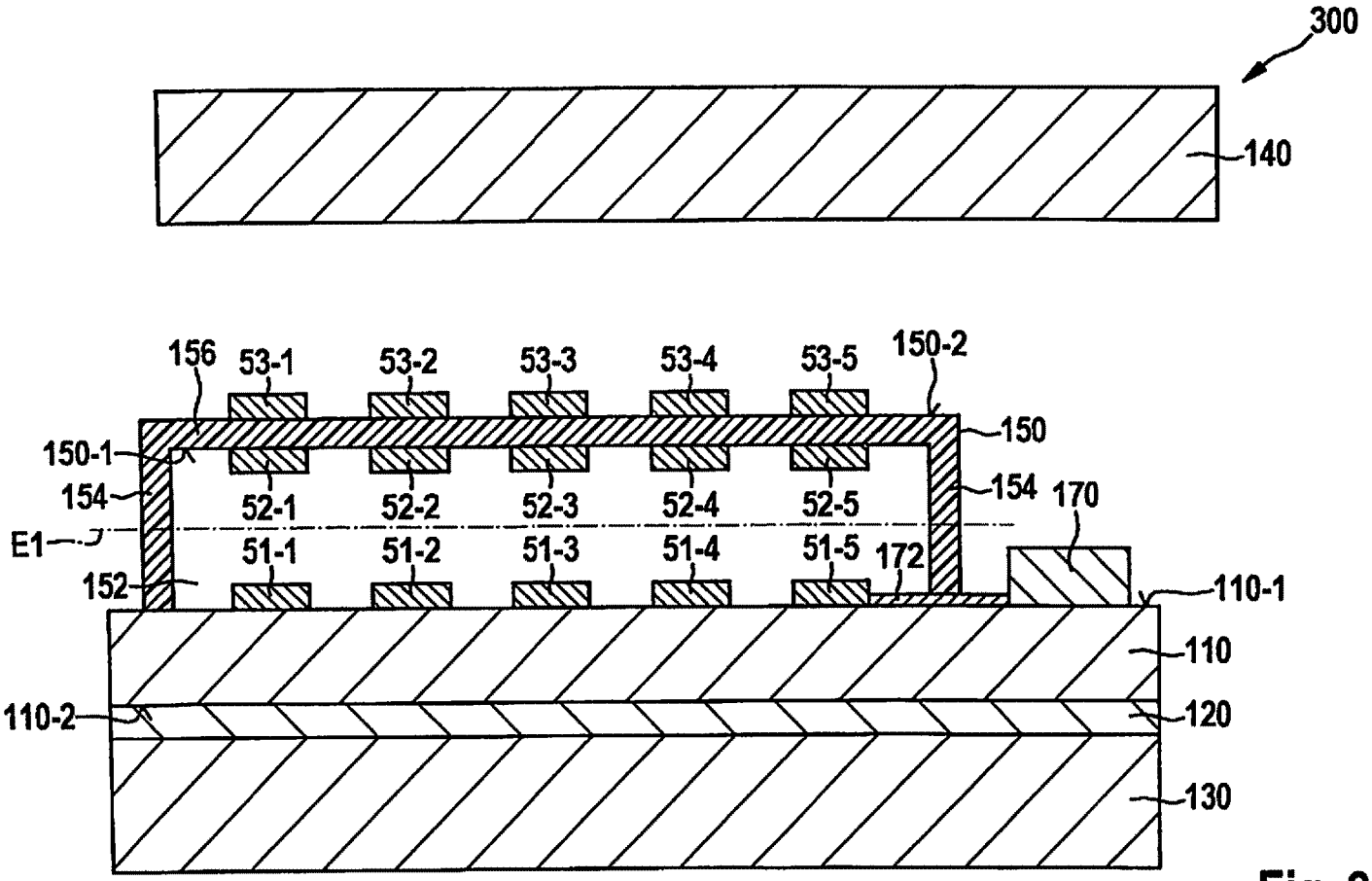
FIG. 3 shows a schematic cross-sectional view of an antenna system 300 according to one specific embodiment of the present invention.

FIG. 3 shows a schematic cross-sectional view of an antenna system 300 according to another specific embodiment of the present invention. Antenna system 300 is a variant of antenna system 200 in FIG. 2, antenna system 300 differing from antenna system 200 in that antenna system 300, in addition to further second antenna structure **53-*i*, also includes second antenna structure 52-*i* from FIG. 1. Thus, antenna system 300 includes three spaced-apart antenna structures with patch elements 51-*i*, 52-*i*, 53-*i*** situated in virtual planes in parallel to one another.

Figure 4:
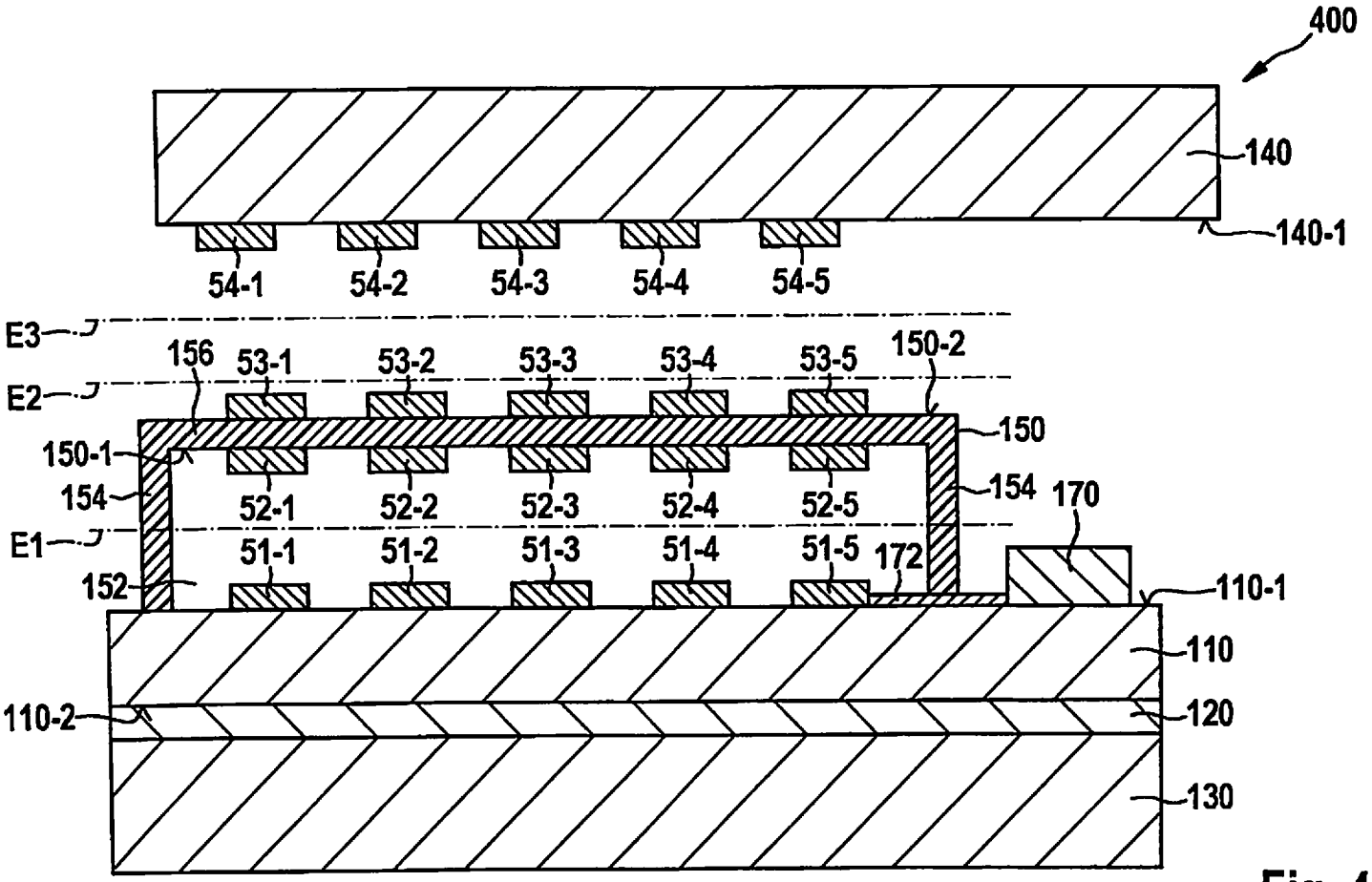
FIG. 4 shows a schematic cross-sectional view of an antenna system 400 according to one specific embodiment of the present invention.

FIG. 4 shows a schematic cross-sectional view of an antenna system 400 according to another specific embodiment of the present invention.

Antenna system 400 is a variant of antenna system 300, and in comparison includes a third antenna structure with fourth patch elements 54-1, 54-2, 54-3, 54-4, and 54-5, collectively denoted below as reference numeral **54-*i* for short. Fourth patch elements 54-*i* are formed at an outer side 140-1 of radome 140 facing substrate 110 as well as carrier device 150. In particular, third antenna structure 54-1 may represent a mirror image of first antenna structure 51-*i* with respect to a second virtual plane of symmetry E2, and/or may represent a mirror image of further second antenna structure 53-*i* with respect to a third virtual plane of symmetry E3**.

The third antenna structure with fourth patch elements **54-*i*, as a variant, is also providable on radome 140 of antenna system 200 or radome 140 according to antenna system 100**.

Figure 5:
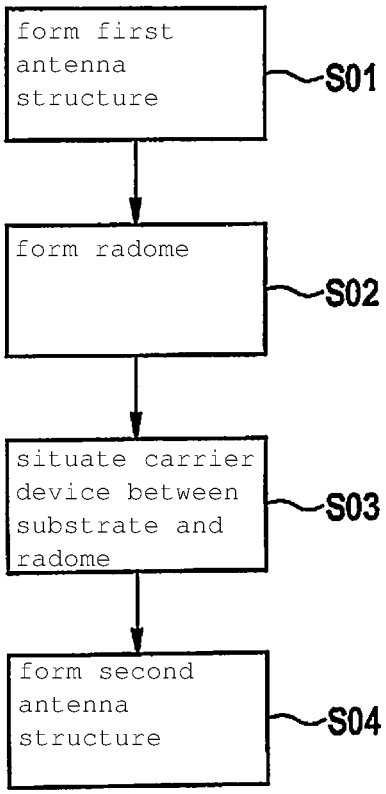
FIG. 5 shows a flow chart for illustrating a method for manufacturing an antenna system according to another specific embodiment of the present invention.
Figure 6A:
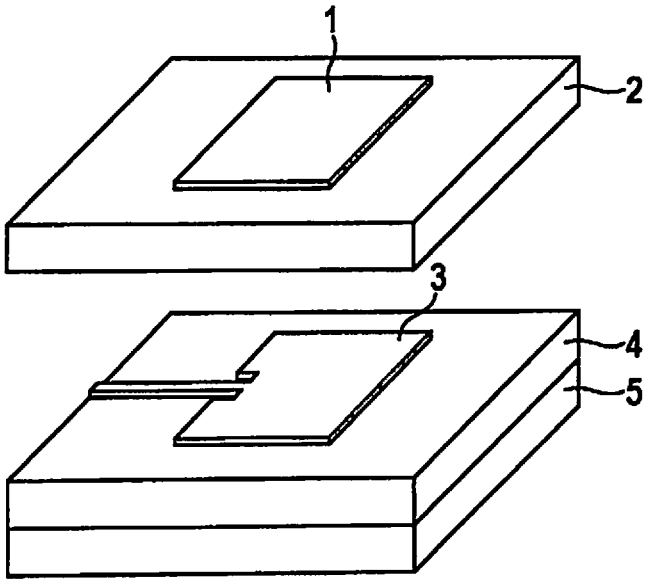
Fig. 6a (RELATED ART)
FIG. 6*a* shows a schematic illustration of an example of an antenna system from the related art.
Figure 6B:
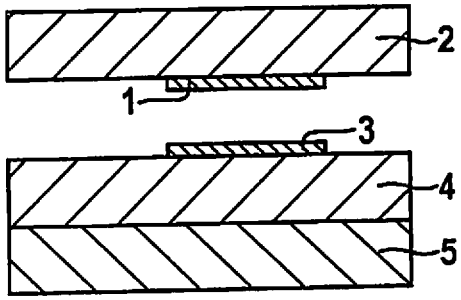
Fig. 6b (RELATED ART)
FIG. 6*b* shows a schematic cross-sectional view of the example of the antenna system from the related art.

FIG. 5 shows a flow chart for illustrating a method for manufacturing an antenna system according to another specific embodiment of the present invention.

The manufacturing method according to FIG. 5 is adaptable in particular for manufacturing one of antenna systems 100, 200, 300, 400. In particular, the manufacturing method is adaptable according to all specific embodiments, variants, and refinements described for the antenna system according to the present invention.

A first antenna structure **51-*i* is formed on a substrate 110, for example in microstrip technology, in a step S01. The antenna structure may include a plurality of individual patch elements 51-1, 51-2, 51-3, 51-4, 51-5. The individual patch elements may be electrically connected to one another, and/or to a transceiver 170 formed on substrate 110, via strip conductors 172**.

A radome 140 that is spaced apart from substrate 110 is formed in a step S02. A carrier device 150 that includes an electrical insulation material or is made of same is situated between substrate 110 and radome 140 in a step S03. The arranging of carrier device 150 may include forming carrier device 150, for example by plastic injection molding, as a substep.

At least one second antenna structure **52-*i*, 53-*i*, which is spaced apart from substrate 110 and radome 140, is formed on carrier device 150 in a step S04. Forming the at least one second antenna structure 52-*i*, 53-*i* may take place before or after carrier device 150 is situated between substrate 110 and radome 140**.

Carrier device 150 may in particular be made of a plastic or may include a plastic. For forming the at least one second antenna structure **52-*i*, 53-*i*, an MID process, for example, is usable with the aid of laser direct structuring (LDS), whereby strip conductor structures that include one or multiple strip conductors are applied on plastics with the aid of laser activation. Flexible films, on which multilayer strip conductor structures may also be applied and which are directly extrusion coated with plastic, represent another option. Likewise, fourth patch elements 54-*i* may also be formed on radome 140**.

Carrier device 150 may also be referred to as an insert. Carrier device 150 may be fastened to radome 140 and/or to substrate 110, for example by gluing or by clipping onto substrate 110 or in boreholes in substrate 110.

The at least one second antenna structure **52-*i*, 53-*i* and carrier device 150 are preferably designed and configured in such a way that the at least one second antenna structure 52-*i*, 53-*i*, i.e., secondary or passive patch elements 52-*i*, 53-*i*, are situated in the so-called near field of first antenna structure 51-*i*, i.e., primary or active patch elements 51-*i*. The at least one second antenna structure 52-*i*, 53-*i* is particularly preferably situated as described with regard to antenna systems 100, 200, 300, 400**.

Although the present invention has been described above with reference to preferred exemplary embodiments, it is not limited thereto, and may be modified in numerous ways. In particular, the present invention may be changed or modified in various ways without departing from the core of the present invention.

For example, a cavity 152 that is formed by carrier device 150 together with substrate 110 and/or with radome 140 may be acted on by a vacuum or filled with a filling gas or a filler material, for example, a foam.

What is claimed is:

1. An antenna system, comprising:

a substrate having a first outer side on which a first antenna structure is mounted;

a radome, spaced apart from the substrate, on the first outer side of the substrate;

a carrier device, situated between the substrate and the radome, the carrier device including an electrical insulation material;

at least one second antenna structure mounted on the carrier device and being spaced apart from the substrate and the radome, wherein the carrier device encloses a cavity by being situated in part directly on the substrate, and in part spaced apart from the substrate, the carrier device including:

a wall section that extends perpendicularly to and directly contacts the substrate, and a cover section that extends parallel to the substrate, the wall section and the cover section being made of the same electrical insulation material;

a transceiver disposed on a surface of the substrate and outside the cavity of the carrier device; and at least one strip conductor disposed on and extending along the surface of the substrate, wherein:

the at least one strip conductor electrically connects the transceiver to the first antenna structure by extending from the transceiver, underneath the wall section, and to the first antenna structure.

2. The antenna system as recited in claim 1, wherein the carrier device is made of the electrical insulation material.

3. The antenna system as recited in claim 1, wherein the electrical insulation material is a thermosetting plastic.

4. The antenna system as recited in claim 1, wherein the carrier device has a one-piece design.

5. The antenna system as recited in claim 1, wherein the carrier device is situated in part directly on the radome, and in part spaced apart from the radome.

6. The antenna system as recited in claim 1, wherein one of the at least one second antenna structures is situated at a first outer side of the carrier device facing the substrate.

7. The antenna system as recited in claim 1, wherein one of the at least one second antenna structures is situated at a second outer side of the carrier device facing away from the substrate.

8. The antenna system as recited in claim 1, wherein a third antenna structure is situated at an outer side of the radome facing the substrate.

9. A method for manufacturing an antenna system, comprising:

forming a first antenna structure on a substrate;

forming a radome that is spaced apart from the substrate;

forming a carrier device, situated between the substrate and the radome, which includes an electrical insulation material;

forming at least one second antenna structure, which is spaced apart from the substrate and the radome, on the carrier device, wherein the carrier device encloses a cavity by being situated in part directly on the substrate, and in part spaced apart from the substrate, the carrier device including:

a wall section that extends perpendicularly to and directly contacts the substrate, and a cover section that extends parallel to the substrate, the wall section and the cover section being made of the same electrical insulation material;

disposing a transceiver on a surface of the substrate and outside the cavity of the carrier device;

disposing at least one strip conductor on the substrate in such a way that the at least one strip conductor extends along the surface of the substrate; and electrically connecting the transceiver to the first antenna structure by causing the at least one strip conductor to extend from the transceiver, underneath the wall section, and to the first antenna structure.

* * * * *